US005102209A

United States Patent [19]

Hesseltine

[11] Patent Number: 5,102,209

[45] Date of Patent: Apr. 7, 1992

[54] PORTABLE DESK APPARATUS

[76] Inventor: Mary A. Hesseltine, Rte. 1, Box 495, Dadeville, Ala. 36853

[21] Appl. No.: 688,981

[22] Filed: Apr. 22, 1991

[51] Int. Cl.[5] ..... A47B 81/00

[52] U.S. Cl. ..... 312/290; 312/244; 312/311

[58] Field of Search ..... 312/244, 283, 290, 311, 312/320; 16/126

[56] References Cited

U.S. PATENT DOCUMENTS

| | | | |
|---|---|---|---|
| 1,543,980 | 6/1925 | Blood | 312/290 |
| 1,573,466 | 2/1926 | Ward | 312/290 X |
| 1,924,494 | 8/1933 | Gelinas | 312/290 X |
| 2,662,989 | 12/1953 | Thatcher | 312/244 X |
| 2,739,863 | 3/1956 | Ferris | 312/290 X |
| 3,099,389 | 7/1963 | Vadnai | 312/311 X |
| 3,562,849 | 2/1971 | Brayshaw | 16/126 |
| 4,451,728 | 5/1984 | McKay et al. | 312/244 X |
| 4,545,522 | 10/1985 | Kerzher | 49/402 X |

*Primary Examiner*—Kenneth J. Dorner
*Assistant Examiner*—Brian K. Green
*Attorney, Agent, or Firm*—Leon Gilden

[57] ABSTRACT

A housing includes a plurality of cavities directed through a forward wall, wherein an uppermost row of the cavities contains slidable drawer members for mounting various stationery components therewithin. Underlying cavities are arranged for positioning cards and sheet members therewithin. The housing includes a top floor spaced above a bottom floor, and the aforenoted cavities positioned below an upper edge of side walls of the housing to provide a writing and containment surface that includes a slot when an uppermost lid is mounted to a forward lid of the housing. A modificaiton of the invention includes a spring plate mounted in the slot to maintain mail and the like directed therewithin, as well as stationary devices to include a clock, stamp dispensing housing, calculator, and a calendar card mounted within a "U" shaped framework mounted within the top lid of the housing.

4 Claims, 4 Drawing Sheets 28
10a
28
39
26
38
31
42a
42
41
43
13
32
37
40
35
11

PORTABLE DESK APPARATUS

BACKGROUND OF THE INVENTION

1. Field of the Invention

The field of invention relates to portable desk apparatus, and more particularly pertains to a new and improved portable desk apparatus wherein the same is arranged for providing a complete operative organization for use a portable desk structure.

2. Description of the Prior Art

Various portable writing surfaces are provided in the prior art for permitting an individual to utilize a writing and associate structure in various locations. Examples of the prior art include U.S. Pat. No. 4,919,498 to Turner setting forth a collapsible desk structure utilizing telescoping legs receivable within the desk apparatus, wherein the desk utilizes a planar writing surface defined as a lid secured into a housing.

U.S. Pat. No. 4,867,513 to Choi sets forth a portable cupboard formed as a collapsible container.

U.S. Pat. No. 4,579,401 to Mears sets forth a collapsible cabinet, wherein the side walls are interfolded to permit interfolding and nesting of the arrangement for storage thereof.

U.S. Pat. No. 4,436,353 to Tucker sets forth a portable storage device and table that is telescopingly mounted within an underlying cabinet.

As such, it may be appreciated that there continues to be a need for a new and improved portable desk apparatus as set forth by the instant invention which addresses both the problems of ease of use as well as effectiveness in construction providing a portable desk structure providing a contained writing surface formed within a perimeter wall structure that further functions as a containment area for mail within a slot of the housing organization and in this respect, the present invention substantially fulfills this need.

SUMMARY OF THE INVENTION

In view of the foregoing disadvantages inherent in the known types of desk apparatus now present in the prior art, the present invention provides a portable desk apparatus wherein the same provides for desk structure that is securable and safely maintained within interengaging top and forward lid structure. As such, the general purpose of the present invention, which will be described subsequently in greater detail, is to provide a new and improved portable desk apparatus which has all the advantages of the prior art desk apparatus and none of the disadvantages.

To attain this, the present invention provides a housing including a plurality of cavities directed through a forward wall, wherein an uppermost row of the cavities contains slidable drawer members for mounting various stationery components therewithin. Underlying cavities are arranged for positioning cards and sheet members therewithin. The housing includes a top floor spaced above a bottom floor, and the aforenoted cavities positioned below an upper edge of side walls of the housng to provide a writing and containment surface that includes a slot when an uppermost lid is mounted to a forward lid of the housing. A modification of the invention includes a spring plate mounted in the slot to maintain mail and the like directed therewithin, as well as stationery devices to include a clock, stamp dispensing housing, calculator, and a calendar card mounted within a "U" shaped framework mounted within the top lid of the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new and improved portable desk apparatus which may be easily and efficiently manufactured and marketed.

It is a further object of the present invention to provide a new and improved portable desk apparatus which is of a durable and reliable construction.

An even further object of the present invention is to provide a new and improved portable desk apparatus which is susceptible of a low cost of manufacture with regard to both materials and labor, and which accordingly is then susceptible of low prices of sale to the consuming public, thereby making such portable desk apparatus economically available to the buying public.

Still yet another object of the present invention is to provide a new and improved portable desk apparatus which provides in the apparatuses and methods of the prior art some of the advantages thereof, while simultaneously overcoming some of the disadvantages normally associated therewith.

Still another object of the present invention is to provide a new and improved portable desk apparatus wherein the same is arranged for providing a self-contained portable desk structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
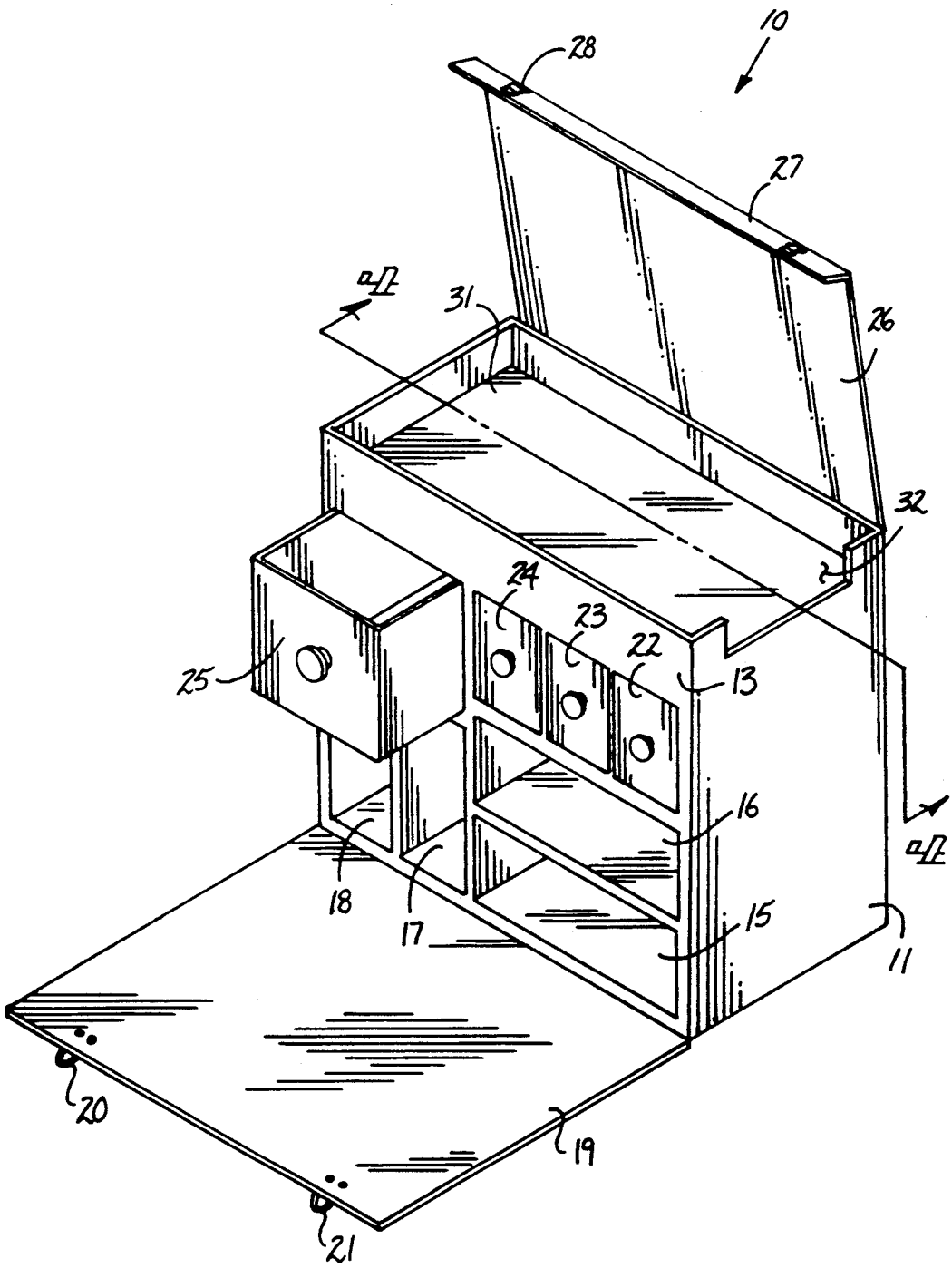
FIG. 1 is an isometric illustration of the instant invention.
Figure 2:
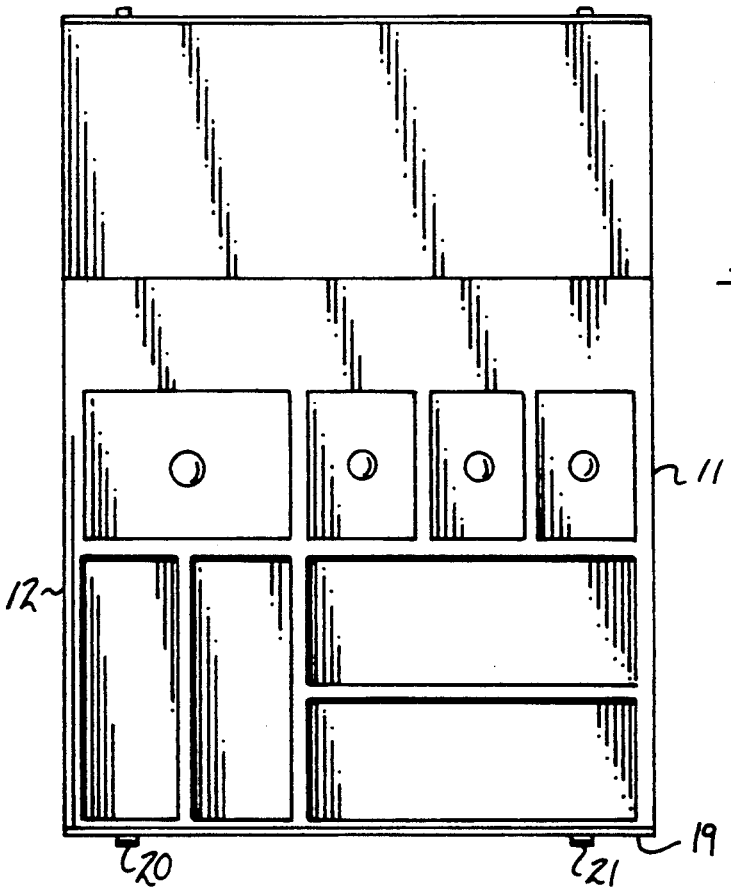
FIG. 2 is an orthographic frontal view, taken in elevation, of the instant invention.

With reference now to the drawings, and in particular to FIGS. 1 to 6 thereof, a new and improved portable desk apparatus embodying the principles and concepts of the present invention and generally designated by the reference numerals 10 and 10*a* will be described.

Figure 4:
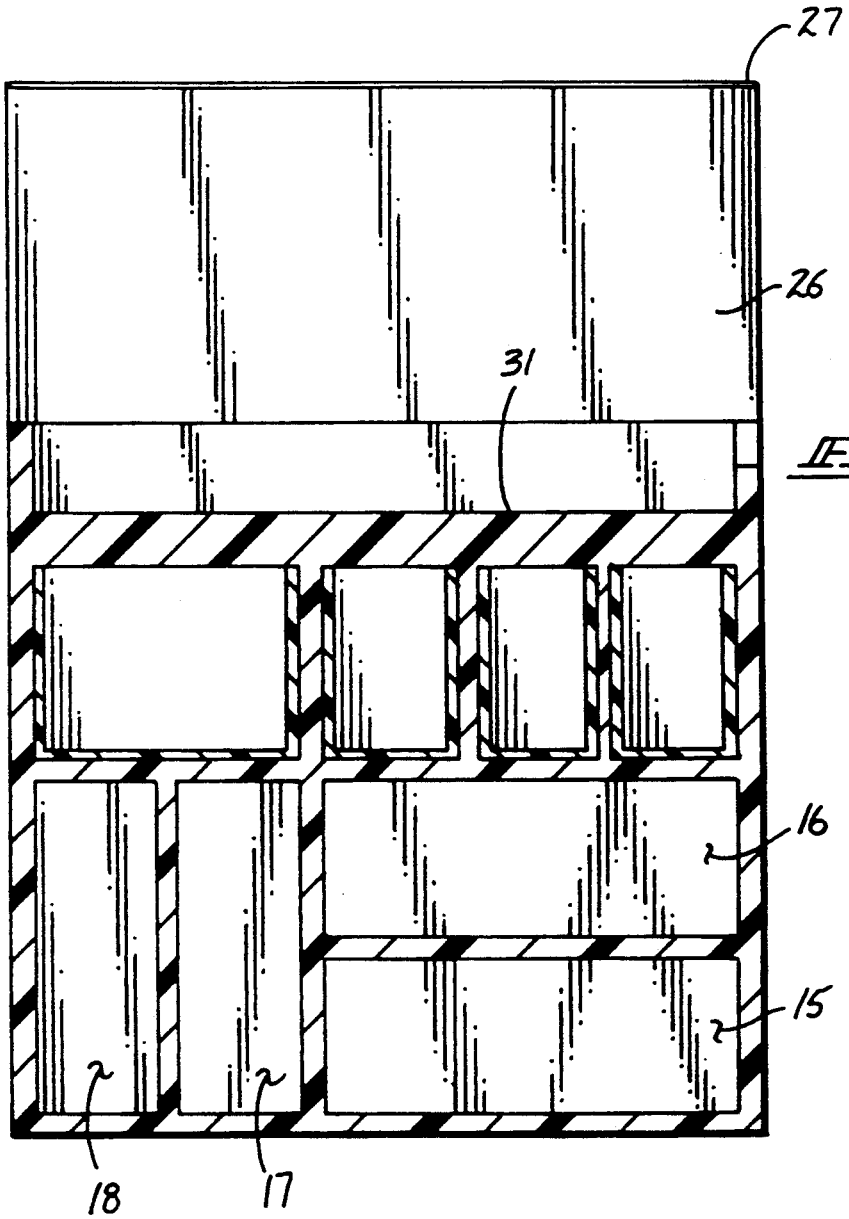
FIG. 4 is an orthographic cross-sectional illustration of the instant invention, taken along the lines 4—4 of FIG. 1 in the direction indicated by the arrows.

More specifically, the portable desk apparatus 10 of the instant invention essentially comprises a housing defined by a generally parallelepiped rectangular configuration defined by a right side wall 11 spaced from and parallel a left side wall 12. A front wall 13 is spaced from and parallel a rear wall 14. The front wall 13 has orthogonally directed therethrough a respective first cavity 15 of a generally rectangular cross-sectional configuration positioned below a second cavity 16 that is coextensively positioned relative to the first cavity. The first and second cavities are arranged to receive various standard and legal size sheets of documentation. A respective third and fourth cavity 17 and 18 are positioned adjacent the first and second cavities, wherein each of the cavities are generally parallel relative to one another, wherein the third and fourth cavities 17 and 18 are also of a rectangular configuration but are rotated generally ninety degrees relative to the first and second cavities to receive cards and the like therewithin. A row of slidable drawers defined by a respective first, second, and third sliding drawer 22, 23, and 24 are positioned above the second cavity 16, with a fourth drawer 25 positioned above the third and fourth cavities 17 and 18 to receive various components, such as pencils, pens, and the like utilized in association with a desk structure. A top lid 26 is pivotally mounted to the upper terminal end edge of the rear wall 14 and includes a top lid flange 27 mounting a plurality of first top lid clip bosses 28. A covering lid 19, whose lower terminal end is hingedly mounted to a forward end edge of the bottom floor 30 of the housing, is configured of a substantially complementary configuration relative to the forward wall 13 to overlie the forward wall 13 coextensively therewith, and includes clasp structure to include a respective first and second front lid clip 20 and 21 to cooperate with the respective clip bosses 28 to thereby secure the front covering lid 19 to the top lid 26. The housing further includes a top floor 31 spaced above and parallel the bottom floor 30 and recessed below a top edge of the side, front, and rear walls of the housing to define a cavity therewithin. The right side wall 11 includes a mail receiving slot 32 to direct mail through the slot 32 onto the top floor 31 when the front covering lid 19 is secured to the top lid 26. It should be noted that the top floor 31 is positioned at a height not to extend below the respective first through fourth sliding drawers 25 to avoid intrusion into the associated cavities containing the sliding drawers, in a manner as illustrated in FIG. 4 for example.

Figure 3:
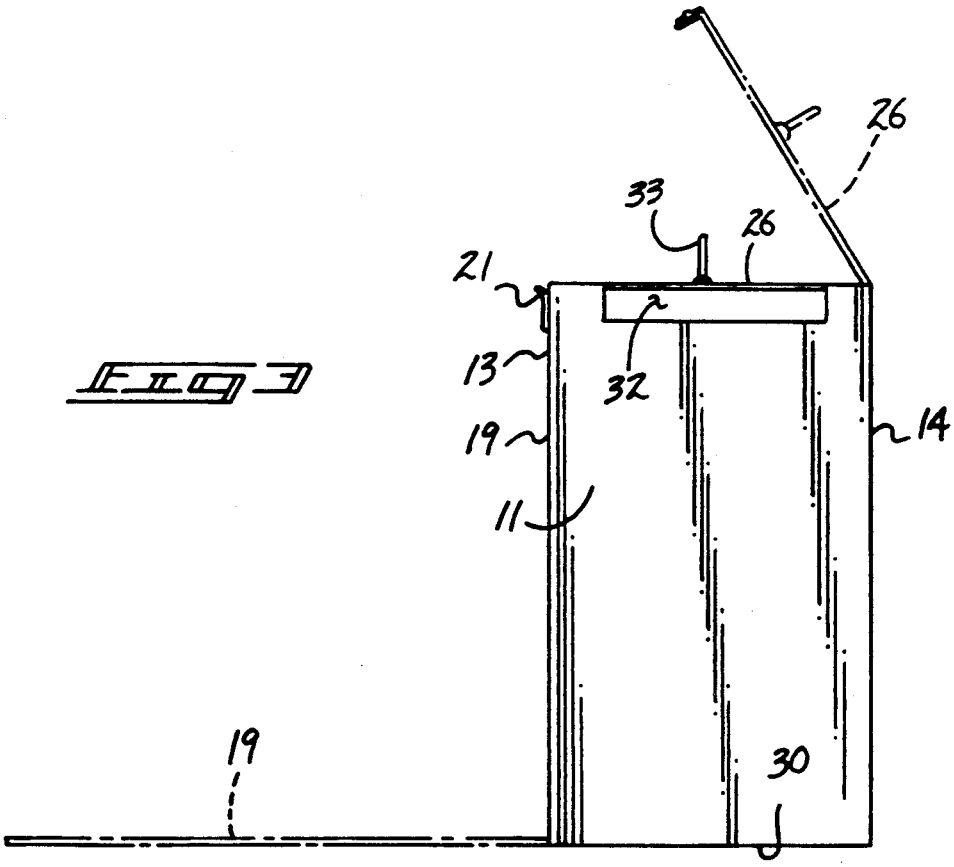
FIG. 3 is an orthographic side view of the instant invention.
Figure 5:
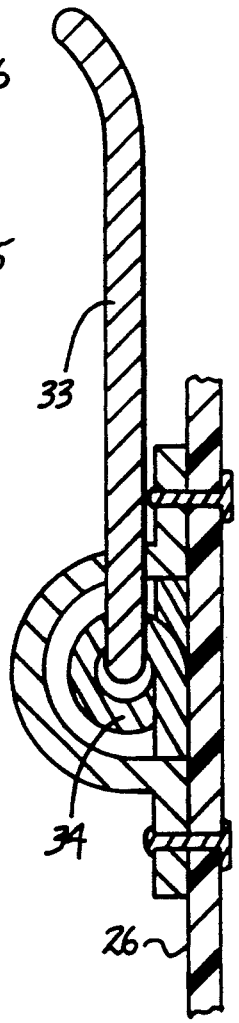
FIG. 5 is an orthographic side cross-sectional illustration of the handle structure mounted to the top lid.

The top lid 26 includes a "U" shaped handle 33, wherein the handle 33 includes a handle spring 34 to bias the handle in a first position that is arranged generally parallel to a top surface of the top lid 26, as illustrated in FIG. 5. Accordingly, the "U" shaped handle 33 is thereafter displaced to a vertical position, as illustrated in FIG. 3 for example, to permit portable manipulation of the housing structure.

Figure 6:
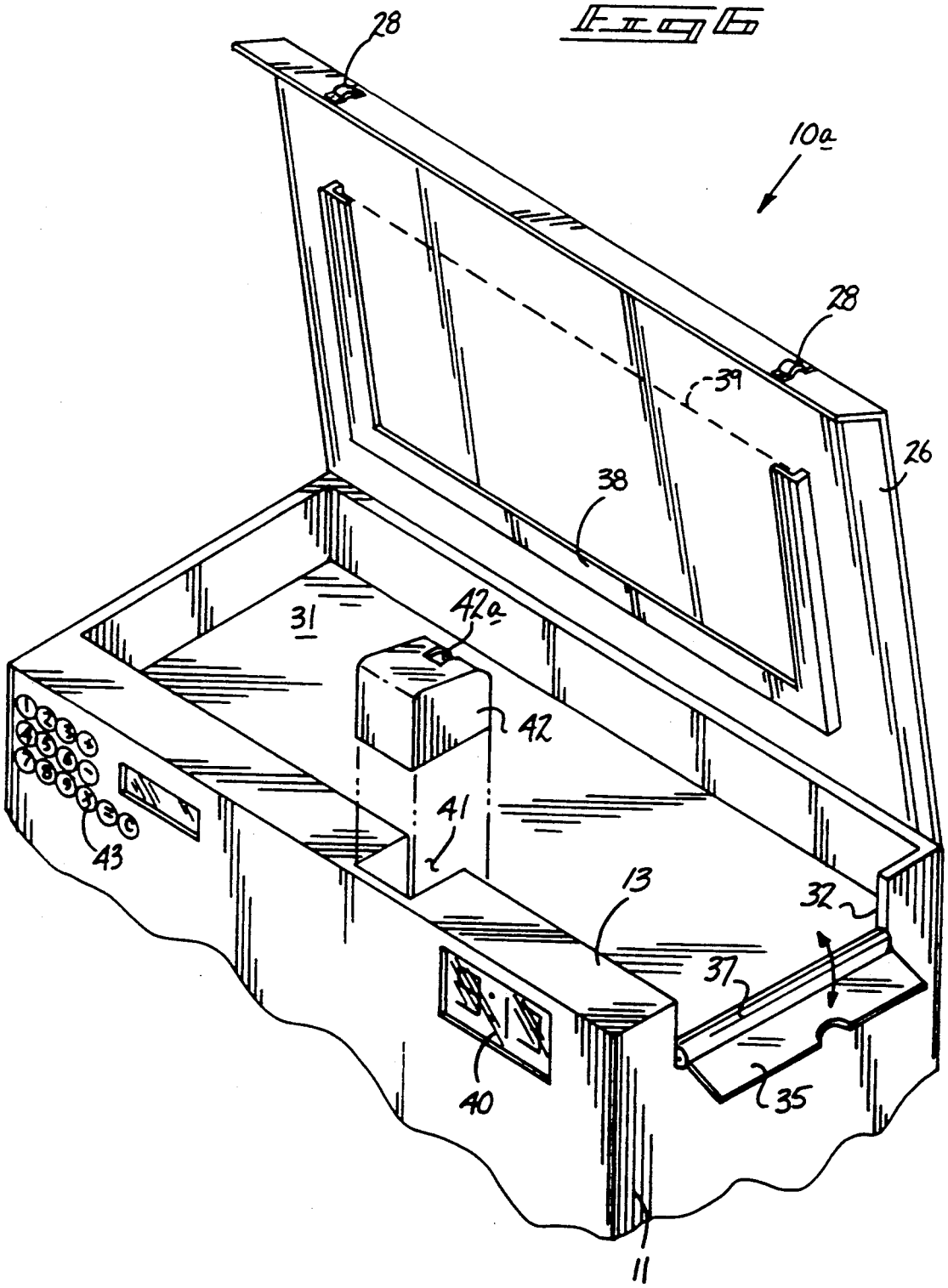
FIG. 6 is an isometric illustration of a modified construction of the instant invention.

FIG. 6 illustrates a modified portable desk apparatus 10*a*, wherein the front wall 13 includes a spring-biased plate 35 coextensively mounted within the slot 32, wherein the spring-biased plate 35 includes a finger access 36 positioned medially through a top edge of the plate 35, with a spring hinge 37 hingedly biasing the plate 35 in a normal vertical orientation, wherein the plate 35 is displaced to a generally horizontal orientation (see FIG. 6) to permit access of mail into the cavity above the floor 31 and the top lid 26.

A "U" shaped frame 38 is mounted to a bottom surface of the top lid 26 defined by a generally "L" shaped cross-sectional configuration to receive a calendar card 39 to provide positioning of the card for visual understanding of various dates and memos to be inscribed upon the calendar card in use of the organization. A clock 40 is recessed within the front wall 13, as well as the use of a calculator 43. A stamp dispensing housing 42, including a housing slot 42*a* to project stamps therefrom, is received within a front wall slot 41 complementarily configured to the configuration of the stamp housing 42.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable desk apparatus, comprising in combination, a housing, the housing including a right side wall and a left side wall, with the right and left side walls arranged in a parallel relationship and further including a front wall spaced from and parallel a rear wall, wherein the housing further includes a bottom floor mounted to a lower terminal edge of each of the right side wall, left side wall, front wall, and rear wall, and the housing defined by a parallelepiped configuration, and the front wall including a first cavity directed orthogonally into the front wall parallel to the floor, with a second cavity positioned above the first cavity coextensive therewith, and a plurality of first drawer members positioned above the second cavity orthogonally directed through the front wall, with each of the first drawer members slidably mounted through the front wall, and a third and fourth cavity of generally rectangular configuration positioned adjacent the first cavity and second cavity, with a further drawer positioned above the third cavity and fourth cavity adjacent the first drawer members, and a front covering lid, the front covering lid defined by a predetermined rectangular configuration, wherein the front wall is defined by a like predetermined rectangular configuration, wherein the front covering lid is arranged to coextensively overlie the front wall, and the front covering lid including a lower terminal edge, the lower terminal edge hingedly mounted to an intersection of the front wall and the floor, and the front covering lid including a plurality of clasp members, and further including a top lid, the top lid including a top lid lower terminal edge, the top lid lower terminal edge hingedly mounted to an upper terminal edge of the rear wall, and the top lid including a top lid flange mounted to a forward edge of the top lid, wherein the top lid flange includes a plurality of flange boss members, wherein the flange boss members are arranged for securement with the clasp members to secure the top lid to the front covering lid, and wherein the right side wall, left side wall, front wall, and rear wall are each of an equal predetermined height and are arranged coextensive relative to one another, and wherein the housing includes a top floor spaced above and parallel to the floor, wherein the top floor is positioned above the first drawer members and the further drawer, and the top floor is positioned below an upper terminal edge of the right side wall, left side wall, front wall, and rear wall to provide an upper cavity, and the right side wall includes a mail receiving slot directed through the right side wall above the top floor, and wherein the top lid includes a handle and a top surface, the handle is hingedly mounted to a top surface of the top lid, and the handle including a handle spring to bias the handle in a first position arranged parallel to the top lid in a first position and manually manipulated to a second position defining an oblique angle between the handle and the top lid, and wherein the mail slot includes a spring-biased plate hingedly mounted within the slot, wherein the spring-biased plate is coextensively directed throughout the slot and includes a spring hinge hingedly biasing the spring-biased plate in a first position aligned with the right side wall, wherein the spring biased plate includes a finger access recess formed through a top edge of the spring-biased plate to provide manual access to the spring-biased plate to displace the spring-biased plate relative to the small slot.

2. An apparatus as set forth in claim 1 wherein the top lid includes a top lid bottom surface, the top lid bottom surface including a "U" shaped framework, the "U" shaped framework defined by an "L" shaped cross-sectional configuration, and a calendar card slidably received within the "U" shaped framework.

3. An apparatus as set forth in claim 2 wherein the front wall includes a front wall slot positioned through an interior surface of the front wall spaced above the top floor, wherein the front wall slot includes a stamp dispensing housing slidably receivable within the front wall slot, the dispensing housing including a housing slot permitting projection of stamps through the housing slot from the stamp dispensing housing.

4. An apparatus as set forth in claim 3 further including a calculator mounted within the front wall spaced above the top floor, and a clock mounted within the front wall spaced above the top floor, wherein the calculator and the clock project through a forward surface of the front wall.

* * * * *